US007931493B2

(12) United States Patent
Cheng

(10) Patent No.: US 7,931,493 B2
(45) Date of Patent: Apr. 26, 2011

(54) CABLE ASSEMBLY WITH A FIRM CONNECTION BETWEEN A PLURALITY OF WIRES AND A CONNECTOR

(75) Inventor: Yung-Chang Cheng, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/535,352

(22) Filed: Aug. 4, 2009

(65) Prior Publication Data

US 2010/0029133 A1 Feb. 4, 2010

(30) Foreign Application Priority Data

Aug. 4, 2008 (CN) ..... 2008 1 0303327

(51) Int. Cl.
*H01R 12/24* (2006.01)

(52) U.S. Cl. ..... 439/497; 439/607.47

(58) Field of Classification Search ..... 439/607.44–607.49, 607.41, 108, 439/610, 497, 579
See application file for complete search history.

(56) References Cited

U.S. PATENT DOCUMENTS

| | | | | |
|---|---|---|---|---|
| 6,641,435 | B1 * | 11/2003 | Ko | 439/579 |
| 6,705,896 | B1 * | 3/2004 | Chang et al. | 439/607.44 |
| 6,830,478 | B1 * | 12/2004 | Ko | 439/579 |
| 7,192,300 | B2 * | 3/2007 | Hashiguchi et al. | 439/497 |
| 7,377,812 | B2 * | 5/2008 | Fukushima et al. | 439/607.41 |
| 7,520,774 | B2 * | 4/2009 | Watanabe | 439/493 |

FOREIGN PATENT DOCUMENTS

| | | |
|---|---|---|
| TW | M332297 | 5/2008 |

* cited by examiner

*Primary Examiner* — Michael C Zarroli
(74) *Attorney, Agent, or Firm* — Wei Te Chung; Andrew C. Cheng; Ming Chieh Chang

(57) ABSTRACT

A cable assembly comprises an insulative housing defining an opening through two opposite top and bottom surfaces. A plurality of contacts are assembled in the insulative housing, each contact has a mating portion and a connecting portion. A plurality of wires are disposed on the top surface of the insulative housing, each wire defines a conductor electrically connected with the connecting portion and a metallic braiding layer surrounding the conductor. A conductive plate is assembled to the insulative housing and soldered with one side of the metallic braiding layers of the wires. A metallic shell encloses the insulative housing and defines a grounding tab extending into the corresponding opening of the insulative housing. The grounding tab is attached and soldered with another side of the metallic braiding layers of the wires facing to the opening of the insulative housing.

16 Claims, 8 Drawing Sheets

CABLE ASSEMBLY WITH A FIRM CONNECTION BETWEEN A PLURALITY OF WIRES AND A CONNECTOR

FIELD OF THE INVENTION

The present invention relates to cable assembly, and more particularly to a cable assembly having a plurality of wires well organized in the cable assembly.

DESCRIPTION OF PRIOR ART

TW Pat. No. M332297 issued to Wu on May 11, 2008 discloses an electrical connector for mating with a complementary connector, it includes an insulative housing 11, a plurality of contacts 12 received into the insulative housing 11, a conductive plate 15 assembled to the insulative housing 11, a plurality of wires 14 electrically connected with the contacts 12 and a pair of metal shells 131, 132 shielding the insulative housing 11. The insulative housing 11 defines a base portion 111 and a tongue portion 112 extending forwardly from a front surface of the base portion 111. A plurality of first contact receiving passages 1121 are formed on a top surface of the tongue portion 112. And a plurality of second contact receiving passages 1111 are formed on a rear surface of the base portion 111 communicated with the first contact receiving passages 1121. Each contact 12 defines a mating portion 121 disposed in the first contact receiving passage 1121 and a terminating portion 122 disposed in the second receiving passage 1121. Each wire has a conductor 141 soldered with the terminating portion 122 and a shielding layer 143 soldered with the conductive plate 15. The plurality of wires 14 are pressed by the conductive plate 15 on a surface thereof and hold by the metal shell 131 by another surface thereof. Thus, the plurality of wires 14 are positioned and hold in the cable assembly by the conductive plate 15 and the metal shell 131. However, the plurality of wires 14 will be loosened or discrete from the cable assembly due to the no engagement between the metal shell 131 and the wires 14.

As discussed above, an improved cable assembly overcoming the shortages of existing technology is needed.

SUMMARY OF THE INVENTION

Accordingly, an object of the present invention is to provide a cable assembly for preventing the wires loosened or discrete from the cable assembly.

In order to achieve the above-mentioned objects, a cable assembly comprises an insulative housing defining an opening through two opposite top and bottom surfaces. A plurality of contacts are formed in the insulative housing, each contact has a mating portion and a connecting portion. A plurality of wires are disposed on the top surface of the insulative housing, each wire defines a conductor electrically connected with the connecting portion and a metallic braiding layer surrounding the conductor. A conductive plate is assembled to the insulative housing and soldered with one side of the metallic braiding layers of the wires. A metallic shell encloses the insulative housing and defines a grounding tab extending into the corresponding opening of the insulative housing. The grounding tab is attached and soldered with another side of the metallic braiding layers of the wires facing to the opening of the insulative housing.

Other objects, features and advantages of the invention will be apparent from the following detailed description taken in connection with the accompanying drawings.

DETAILED DESCRIPTION OF PREFERRED EMBODIMENTS

Figure 1:
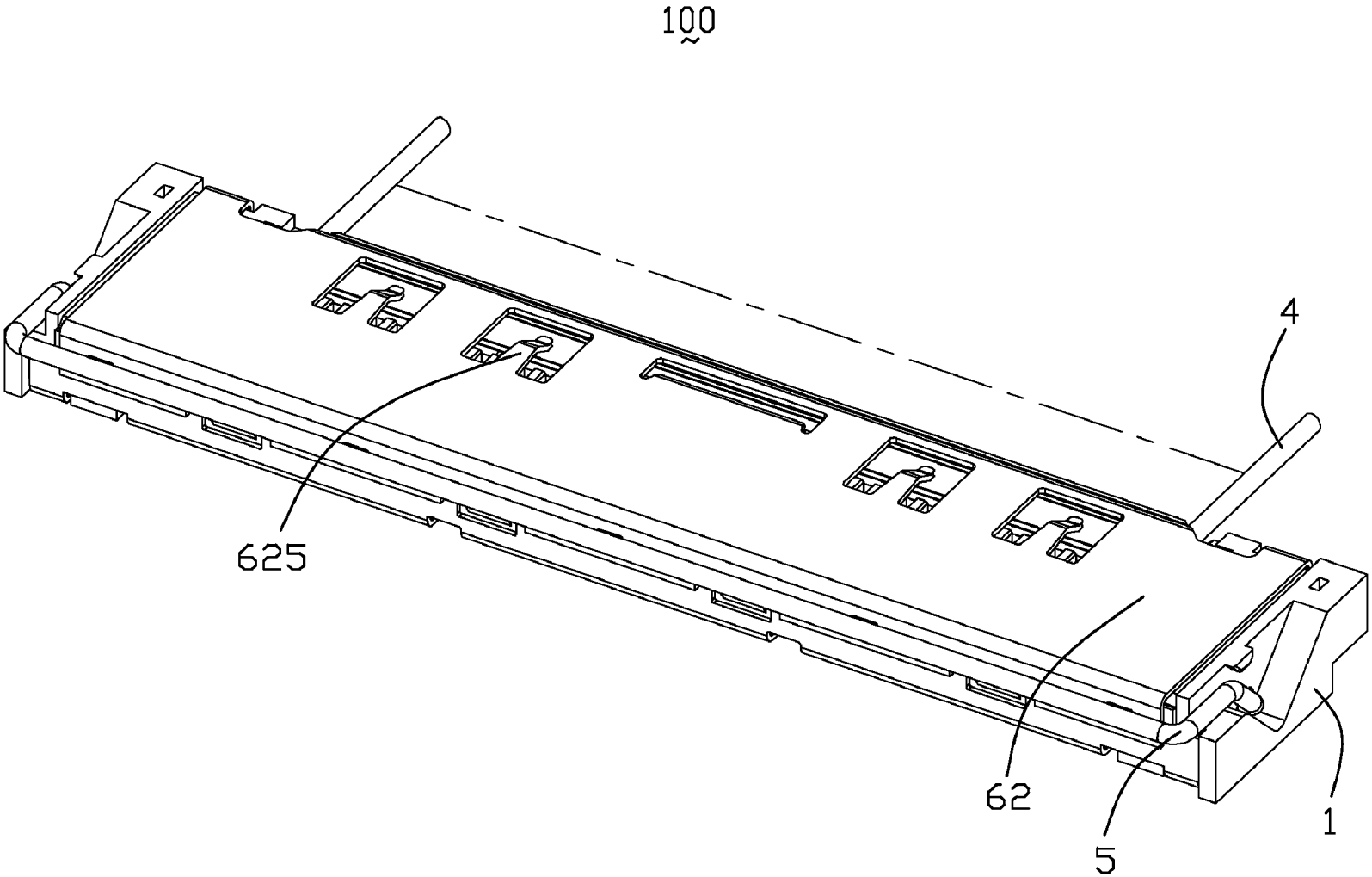
FIG. 1 is a perspective view of a cable assembly in accordance with the present invention.

Reference will now be made to the drawing figures to describe the present invention in detail.

Referring to FIGS. 1 to 4, a cable assembly in accordance with the present invention, generally designated 100, is adapted for mating with a complementary connectors (not shown). The cable assembly 100 includes an insulative housing 1 and a plurality of contacts 2 received into the insulative housing 1. A plurality of wires 4 are electrically connected with the corresponding contacts 2. An elongate conductive plate 3 is assembled to the insulative housing 1 and attached to one side of the plurality of wires 4. An pull bar 5 is assembled to the insulative housing 1. A first and second shielding member 61, 62 are covered to the insulative housing 1.

Figure 3:
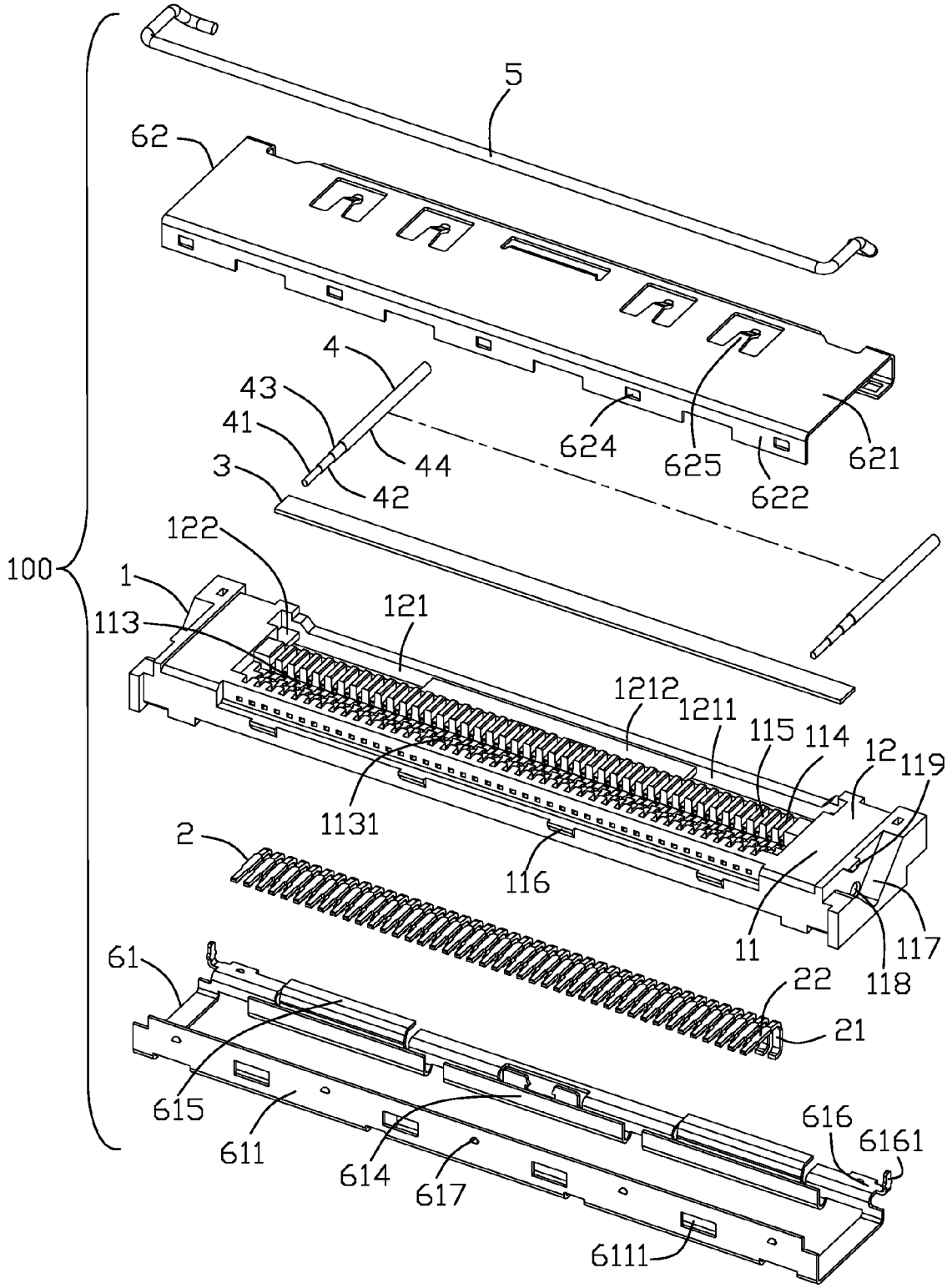
FIG. 3 is an exploded, perspective view of the cable assembly of FIG. 1.
Figure 4:
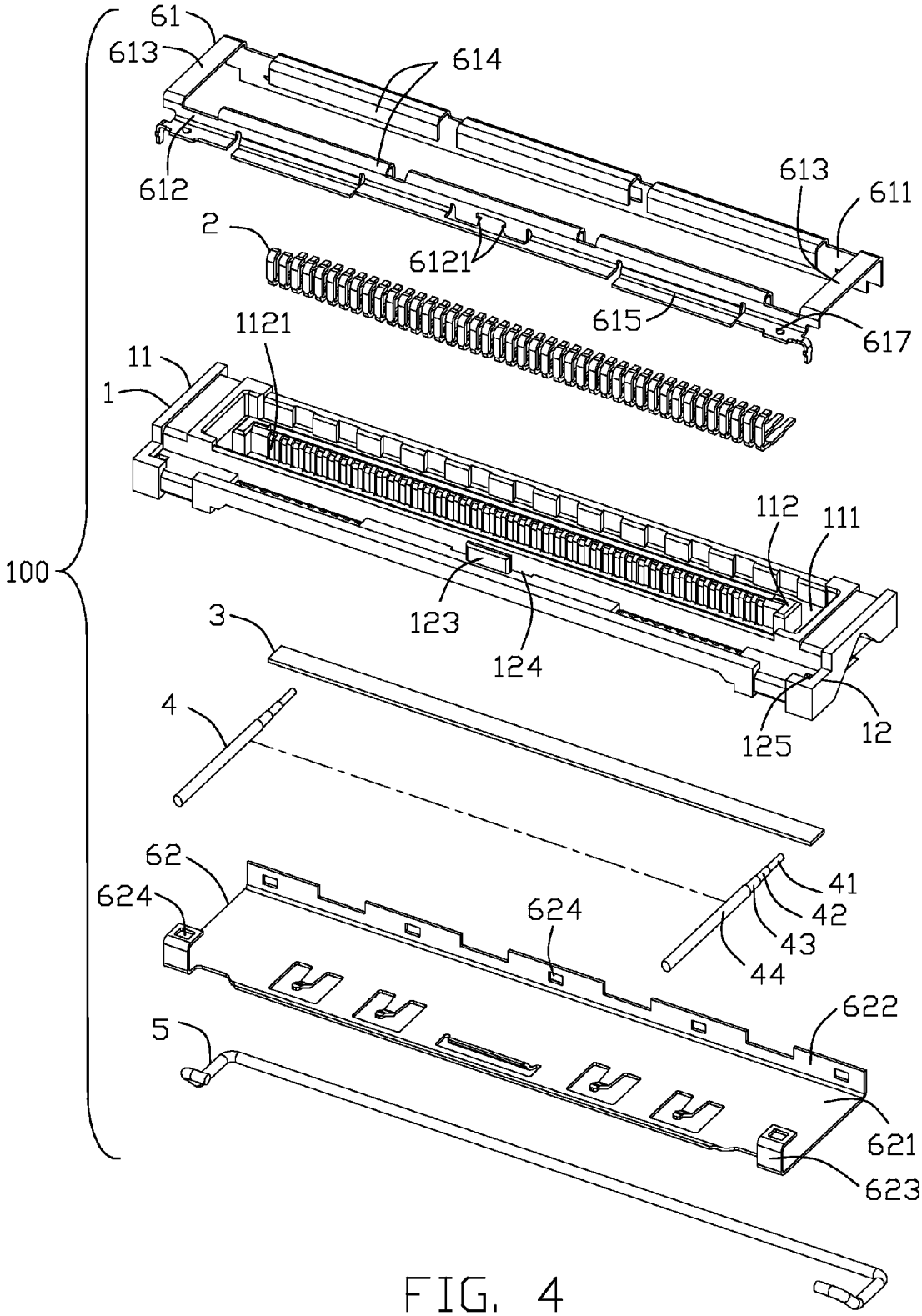
FIG. 4 is an exploded, perspective view of the cable assembly of FIG. 2.
Figure 5:
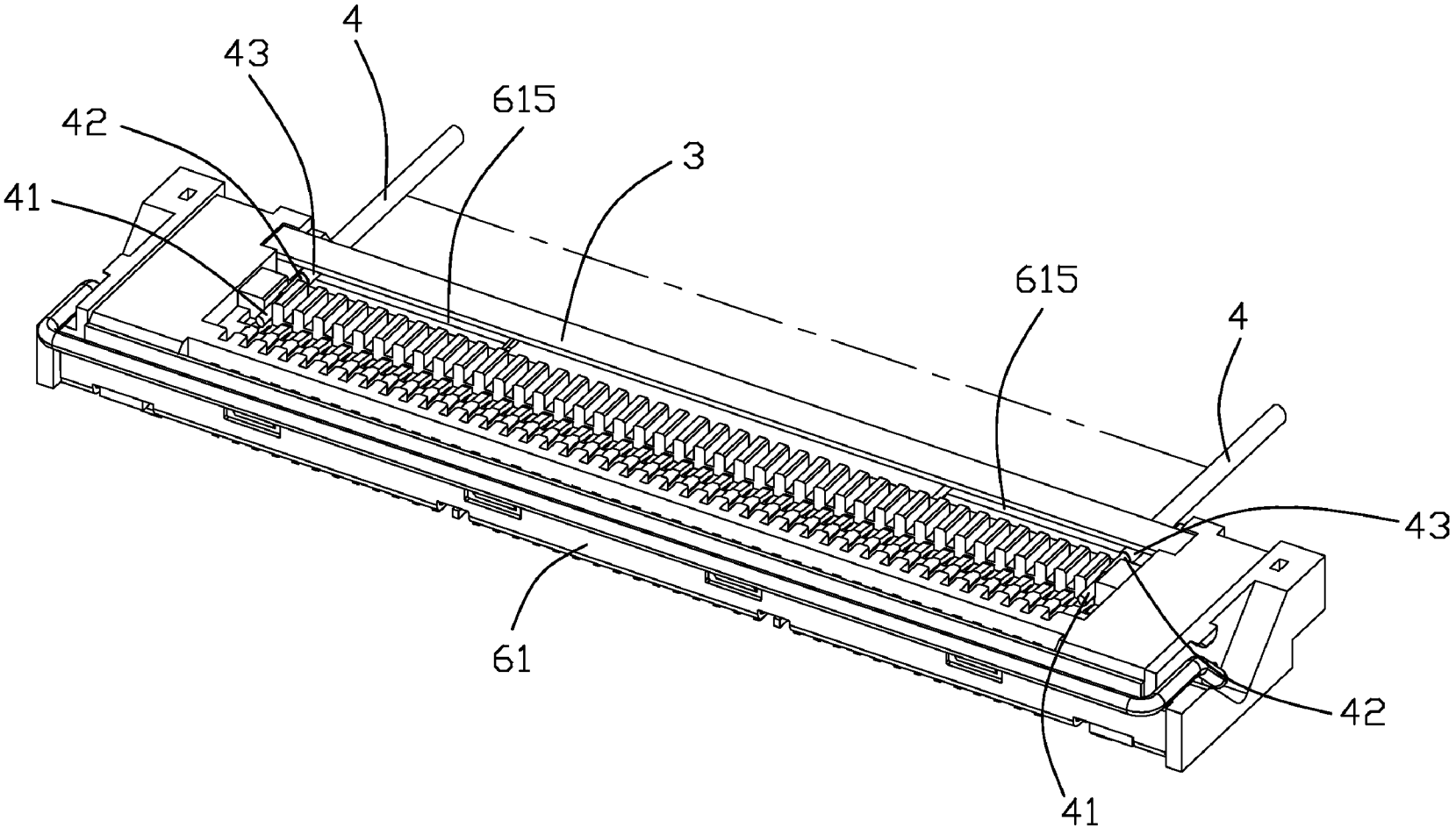
FIG. 5 is a partial assembled, perspective view of the cable assembly of FIG. 3.
Figure 6:
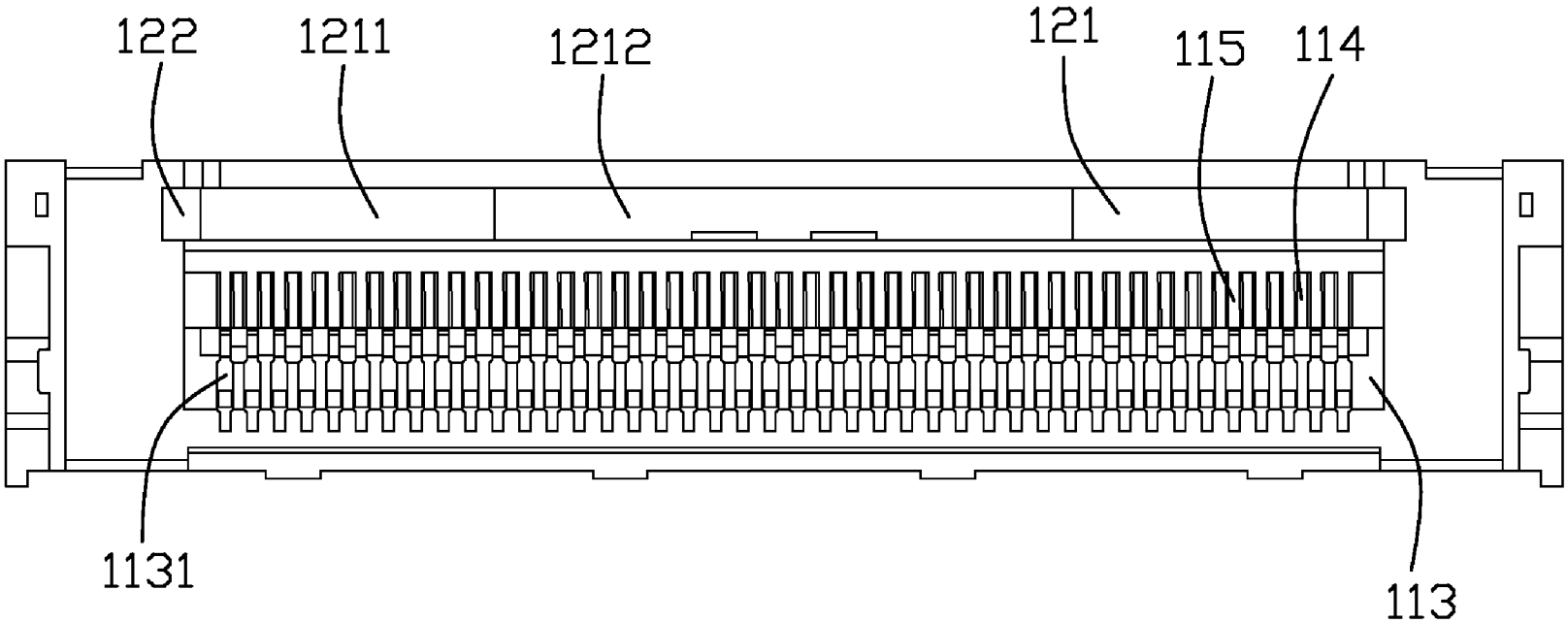
FIG. 6 is a top plan view of an insulative housing of the FIG. 3.
Figure 7:
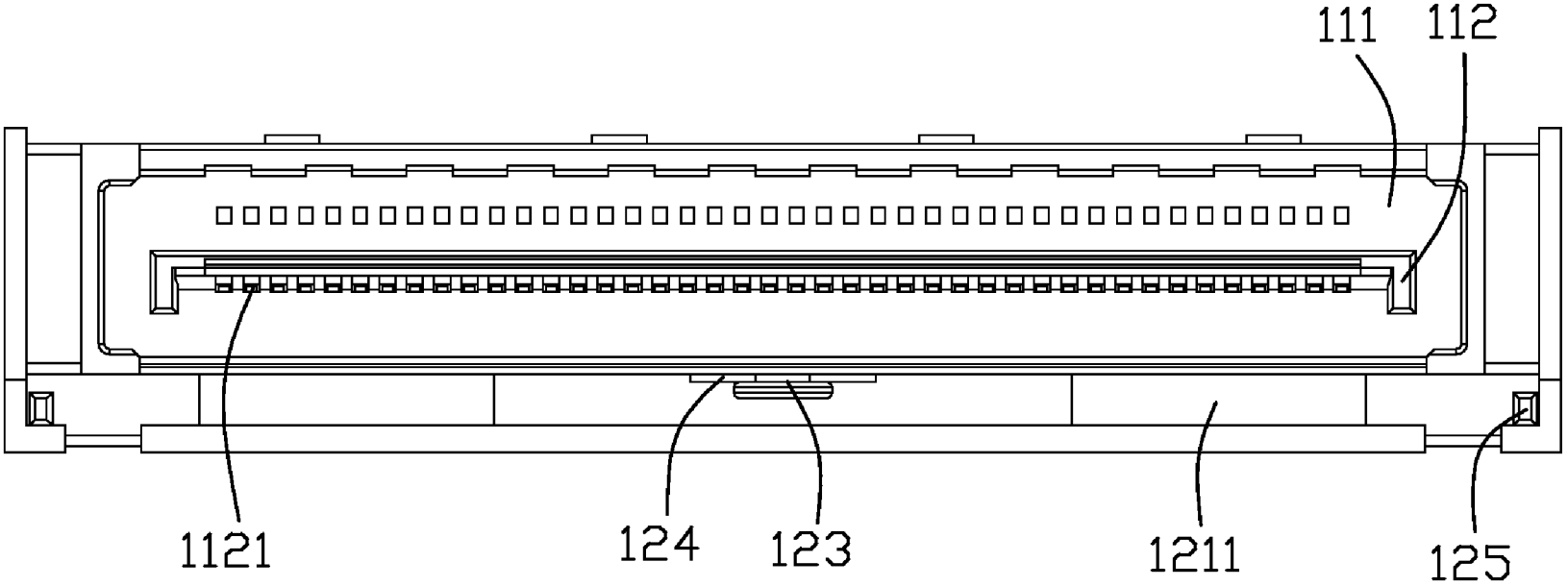
FIG. 7 is a bottom plan view of an insulative housing of the FIG. 3.
Figure 8:
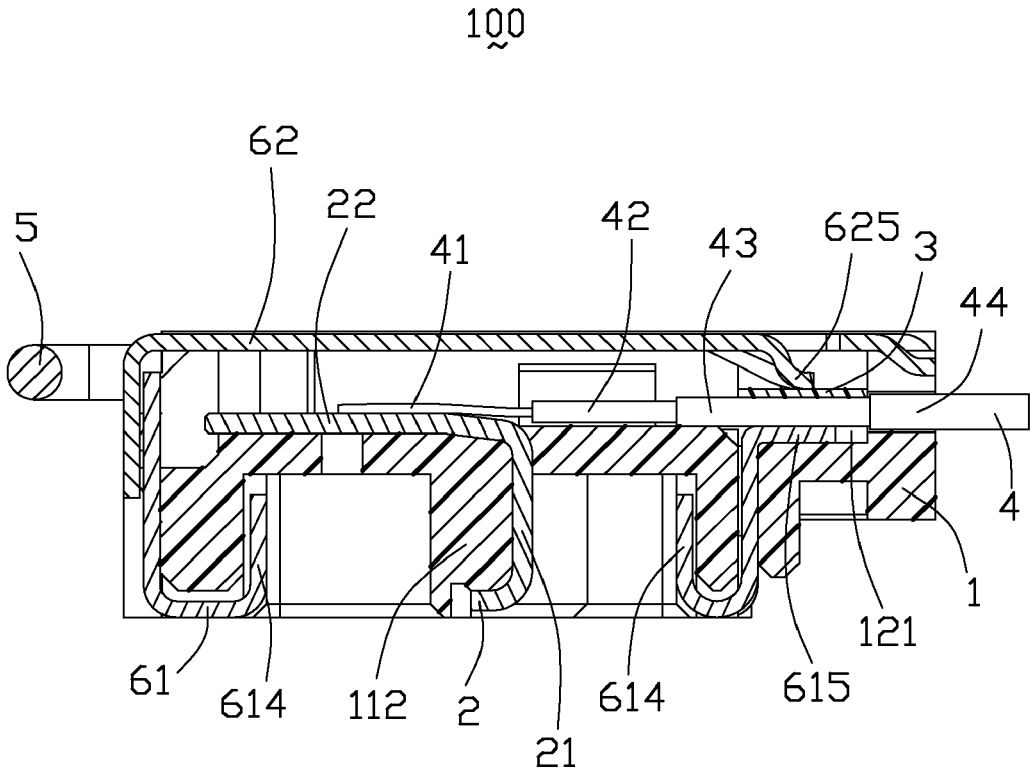
FIG. 8 is a cross section view of the cable assembly of FIG. 1 taken along line 8-8.

Referring to FIG. 3 and 4 in conjunction with FIGS. 6 and 7, the insulative housing 1 defines a base portion 11 and a supporting portion 12 extending rearwardly from the base portion 11. The base portion 11 defines a receiving room 111 on a bottom surface thereof with a tongue portion 112 therein. The tongue portion 112 extends downwardly from a bottom surface of the receiving room 11 and is perpendicular to the base portion 11. The tongue portion 112 defines a plurality of first terminal receiving passages 1121 on a rear surface thereof. And the first terminal receiving passages 1121 extend upwardly from a bottom end of the tongue portion 112 to a top surface of the base portion 11 and are arranged side by side along a transversal direction. An elongate slot 113 extending in a widthwise direction is formed on the top surface of the base portion 11. A plurality of second terminal receiving passages 1131 are formed on the top surface of the base portion 11 and extends along a longitudinal direction. So the first terminal receiving passage 1121 is perpendicular to the second terminal receiving passage 1131. The first and second terminal receiving passages 1121, 1131 are communicated with each other by the slot 113. Each end of the second terminal receiving passage 1131 is disposed in the base portion 11, not exposed out the top surface of the base portion 11. A plurality of channels 115 are formed on the top surface of the base portion 11 for the corresponding wires 4 passing through and arranged side by side along a widthwise direction. Two adjacent channels 115 are spaced by a rib 114. The second terminal receiving passages 1131 are spaced apart with the plurality of channels 115 by the slot 113 in a longitudinal direction. A plurality of wedge-shaped blocks 116 are formed on a front surface of the base portion 11 for locking with the second shielding member 62. A pair of cutouts 117 are respectively formed on opposite sides of the base portion 11. A pair of receiving holes 118 are formed in the cutouts 117 for receiving two ends of the pull bar 5. A pair of protruding portions 119 are formed in the cutouts 117 for limiting the excessive movement of the pull bar 5.

Also referring to FIG. 3 and 4 in conjunction with FIGS. 6 and 7, the supporting portion 12 of the insulative housing 1 defines an opening 121 through two opposite top and bottom surfaces thereof. A supporting plate 1212 is formed in a middle section of the opening 121. Thus, the opening 121 is divided into two openings 1211 spaced apart by the supporting plate 1212. A pair of recesses 122 are respectively formed on two sides of the opening 121 for receiving two ends of the conductive plate 3. An embossment 123 is formed on a bottom surface of the supporting plate 1212 and attached to a rear surface of the base portion 11 of the insulative housing 1. A pair of indentations 124 are formed on the bottom surface of the supporting plate 3 and disposed at two sides of the embossment 123. A pair of positioning holes 125 are formed at two sides of the bottom surface of the insulative housing 1.

Figure 2:
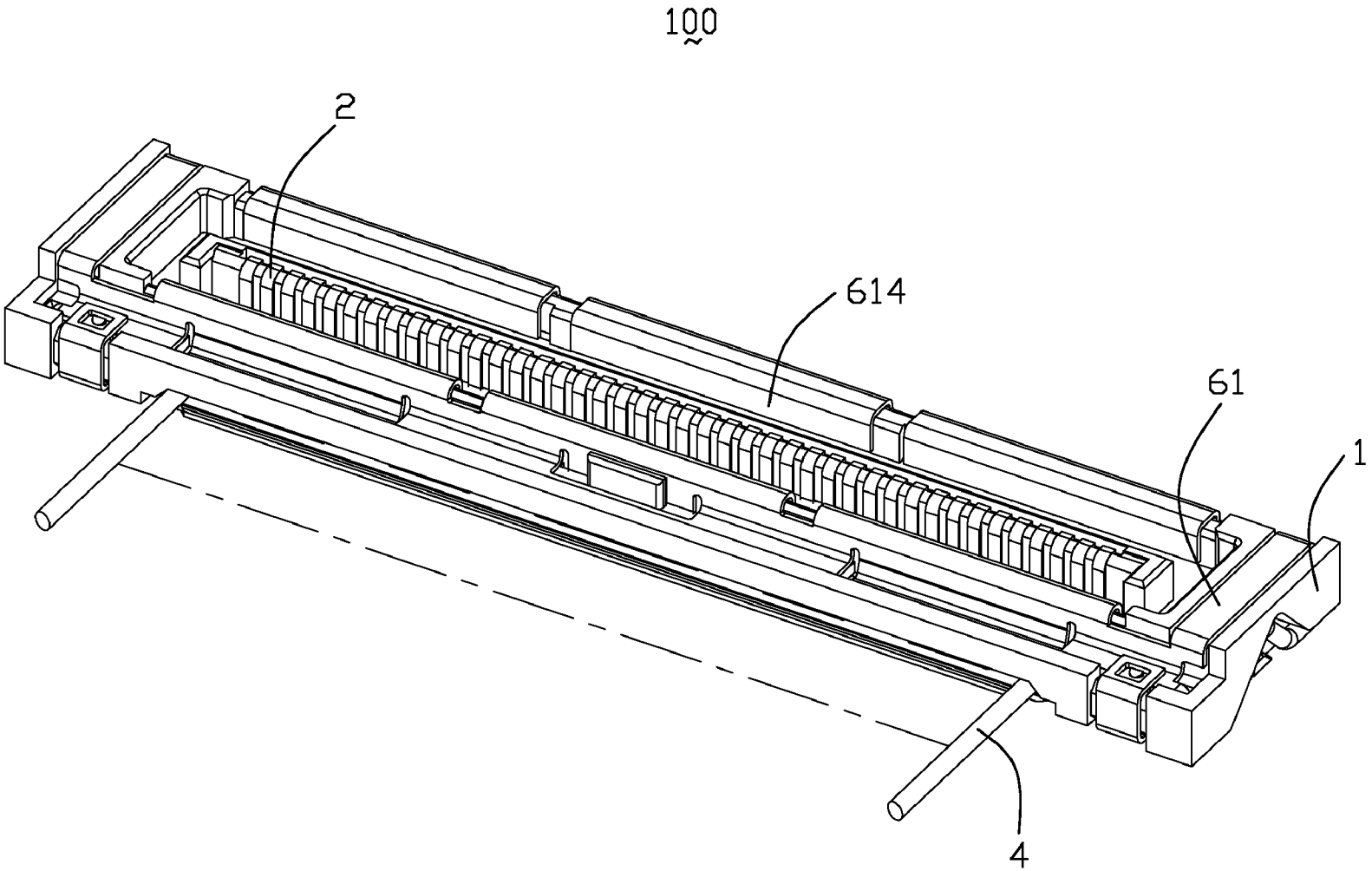
FIG. 2 is similar to FIG. 1, but viewed from another aspect.

Referring to FIG. 2 to 4, each contact 2 comprises a mating portion 21 and a connecting portion 22 extending from an end of the mating portion 21 and perpendicular to the mating portion 21. Each mating portion 21 of the contact 2 is received into the first terminal receiving passage 1121, and each connecting portion 22 is received into the second receiving passage 1131.

Referring to FIGS. 1 to 4, each wire 4 has a conductor 41 and an insulation sheathing 422 wrapped over the surface of the conductor 41. The each wire 4 further comprises a metallic braiding layer 43 surrounding the insulation sheathing 42 and a jacket 44 surrounding the metallic braiding layer 43. The conductor 41 has a front end exposed to outside and soldered with the connecting portion 22 of each contact 2. And the metallic braiding layer 43 is soldered with the conductive plate 3.

Referring to FIGS. 3 to 4 in conjunction with FIGS. 1 to 2, the first shielding member 61 is generally stamped from a piece of sheet metal or other conductive materials. The first shielding member 61 assembled to the bottom surface of the insulative housing 1 comprises a front wall 611 attached to the front surface of the insulative housing 1, a rear wall 612 attached to the rear surface of the insulative housing and a pair of side walls 613 respectively connected with two side ends of the front wall 611 and the rear wall 612. An opening is enclosed by the front, rear and pair of side walls 611, 612, 613. A plurality of guiding tabs 614 extend inwardly and upwardly respectively from a bottom end of the front wall 611 and the rear wall 612. A pair of grounding tabs 615 extend upwardly and outwardly from a top end of the rear wall 612. A pair of spaced locking tabs 6121 are formed in a middle section of the rear wall 612 and can be received into the pair of indentations 124 of the insulative housing 1. A pair of positioning tabs 616 are formed at two ends of the rear wall 612 and respectively defines a post 6161 for engaging with the insulative housing 1 and a protrusion 617 for engaging with the second shielding member 62. The locking tab 6121 and the positioning tab 616 are all used to position the first shielding member 61 to the insulative housing 1. The front wall 611 defines a plurality of openings 6111 for engaging with the wedge-shaped blocks 116 of the insulative housing 1 and a plurality of protrusion 617 for engaging with the second shielding member 62.

Referring to FIGS. 3 to 4 in conduction with FIGS. 1 to 2, the second shielding member 62 is generally stamped from a piece of sheet metal or other conductive materials. The second shielding member 62 covered to the top surface of the insulative housing 1 comprises a top wall 621, a plurality of engaging tabs 622 extending downwardly from a front edge of the top wall 621 and a pair of engaging portions 623 extending downwardly from two sides of a rear edge of the top wall 621. Each engaging tab 622 and engaging portion 623 both defines an opening 624 for receiving the protrusion 617 of the first shielding member 61. A plurality of elastic pieces 625 are formed in the second shielding member 62 for contacting with the conductive plate 3.

In assembling, as shown in FIGS. 1 to 8, the plurality of contacts 2 are received into the insulative housing 1, the mating portion 21 of the contact 2 is received into the first terminal receiving passage 1121 of the insulative housing 1, and the connecting portion 22 is received into the second receiving passage 1131 of the insulative housing 1.

Subsequently, assembling the first shielding member 61 to the bottom surface of the insulative housing 1 through the openings 6111 of the front wall 611 engaged with the wedge-shaped blocks 116 of the insulative housing 1, the pair of the locking tabs 6121 received into the pair of indentations 124 and the pair of posts 6161 received into the pair of positioning holes 125 of the insulative housing 1. At this time, the pair of grounding tabs 615 are respectively extended into the two openings 1211 and has a top surface in alignment with the top surface of the supporting plate 1212 in a horizontal direction.

Then assembling the plurality of wires 4 to the top surface of the insulative housing 1. The exposed conductor of each wire 4 passes through the channel 115 and extends into the slot 113 of the insulative housing 1. Each conductor 41 of the wire 4 is supported by the connecting portion 22 of the contact 2. The metallic braiding layers 53 of the wires 4 are all supported by the grounding tabs 615 and the supporting plate 1212.

Then soldering the conductors 41 of the wires 4 to the connecting portions 22 of the contacts 2. And soldering the metallic braiding layers 43 of some wires 4 to the corresponding grounding tabs 615. Thus, one side of some wires 4 are electrically and mechanically connected with the grounding tabs 615. The metallic braiding layers 43 of the wires 4 are also integrated with the conductive 3.

Then assembling the conductive plate 3 to the insulative housing 1 and covering one side of the metallic braiding layers 43 of the wires 4. Two ends of the conductive plate 3 are received into the pair of recesses 122 to limit the conductive plate 3 movement in a transversal and longitudinal direction. Then soldering the conductive plate 3 to the metallic braiding layers 43 of the wires 4. Thus, another side of the wires 4 are connected and integrated with the conductive plate 3. The wires 4 are sandwiched between the conductive plate 3 and the pair of grounding tabs 615 and the supporting plate 1212. So the wires 4 will not be swayed in a transversal or vertical direction. So, the wires 4 are well positioned and organized in the insulative housing 1 by the conductive plate 3, the supporting plate 1212 of the insulative housing and the pair of grounding tabs 615 of the first shielding member 1.

At last, assembling the second shielding member 62 to the top surface of insulative housing 1 through the protrusions 617 of the first shielding member 61 cooperated with the corresponding openings 624 of the engaging tab 622 and the engaging portion 623. Thus, the second shielding member 62 is fully assembled to the insulative housing 1. A plurality of the elastic pieces 625 attach to the conductive plate 3. Then assembling the pull bar 5 to the insulative housing 1 through two side ends of the pull bar 5 received into the corresponding receiving holes 118. Simply by raising the pull bar 5, the cable assembly 100 can easily be disconnected from the complementary connector.

Through the above assembling steps, the cable assembly 100 is accomplished.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing defining an opening through two opposite top and bottom surfaces;

a plurality of contacts assembled in the insulative housing, each contact having a mating portion and a connecting portion;

a plurality of wires disposed on the top surface of the insulative housing, each wire defining a conductor electrically connected with the connecting portion and a metallic braiding layer surrounding the conductor;

a conductive plate assembled to the insulative housing and soldered with one side of the metallic braiding layers of the wires; and a metallic shell enclosing the insulative housing, defining a grounding tab extending into the corresponding opening of the insulative housing, the grounding tab attached and soldered with another side of the metallic braiding layers of the wires, and the metallic shell includes a first shielding member and a second shielding member engaged with each other.

2. The cable assembly as recited in claim 1, wherein the insulative housing has a receiving room in the bottom surface thereof, a tongue portion is formed in the receiving room and perpendicular to the bottom surface of the insulative housing.

3. The cable assembly as recited in claim 2, wherein a plurality of first receiving passages are formed in the tongue portion, a slot is formed on the top surface of the insulative housing and communicated with the first receiving passages, a plurality of second receiving passages are formed on the top surface extending in a longitudinal direction and communicated with the slot.

4. The cable assembly as recited in claim 3, wherein the mating portion of each contact is received into the first receiving passage and a connecting portion of each contact is received into the second receiving passage.

5. The cable assembly as recited in claim 3, wherein a plurality of channels are formed on the top surface of the insulative housing and respectively in alignment with the second receiving passages in a longitudinal direction.

6. The cable assembly as recited in claim 5, wherein each conductor of the wire has a front end portion passes through the corresponding channel and locates on the top of the connecting portion of the contact.

7. The cable assembly as recited in claim 1, wherein the first shielding member defines a plurality of elastic pieces contacting with the conductive plate, and the grounding tab is formed on the second shielding member.

8. The cable assembly as recited in claim 1, wherein a pull bar is assembled to the insulative housing.

9. The cable assembly as recited in claim 1, wherein a supporting plate is formed in the opening, and the opening is divided into two segments, the metallic shell defines a pair of grounding tabs extending into the corresponding openings of the insulative housing.

10. A cable assembly, comprising:

an insulative housing defining an opening through two opposite top and bottom surfaces;

a plurality of contacts formed in the insulative housing;

a plurality of wires disposed on the top surface of the insulative housing and electrically connected with the corresponding contacts, each wire comprising a metallic braiding layer therein;

a conductive plate assembled to the insulative housing and electrically and mechanically connected with a top side of the metallic braiding layers of the wires;

a metallic shell enclosing the insulative housing, the metallic shell including an upper shielding member and a lower shielding member defining a grounding tab extending into the corresponding opening of the insulative housing and connecting with a bottom side of the metallic braiding layers of the wires.

11. The cable assembly as recited in claim 10, wherein the conductive plate is soldered with the metallic braiding layers of the wires, the grounding tab of the metallic shell is also soldered with the metallic braiding layers of the wires.

12. The cable assembly as recited in claim 10, wherein the metallic braiding layers of the wires are sandwiched by the grounding tab of the metallic shell and the conductive plate.

13. The cable assembly as recited in claim 10, wherein the upper shielding member of the metallic shell defines a plurality of elastic pieces contacting with the conductive plate.

14. The cable assembly as recited in claim 10, wherein a supporting plate is formed in the opening, and the opening is divided into two segments, the metallic shell defines a pair of grounding tabs extending into the corresponding openings of the insulative housing.

15. A cable connector assembly comprising:

an insulative elongated housing defining an elongated side and a short transverse side;

a plurality of contacts disposed in the housing along the elongated side;

a plurality of wires mechanically and electrically connected to the corresponding contacts, respectively, and extending in a direction perpendicular to said elongated side;

an upper metallic shield position assembled upon an upper face of the housing; and an elongated conductive plate assembled unto an underside of the housing and cooperating with the upper metallic to sandwich the wires therebetween in a vertical direction; wherein braiding of some wires are soldered to the conductive plate; wherein a bottom shield is attached upon the underside of the housing to cover the conductive plate.

16. The cable connector assembly as claimed in claim 15, wherein said upper shield and said bottom shield are assemble to each other.

* * * * *